US007810177B2

(12) United States Patent
Yang et al.

(10) Patent No.: US 7,810,177 B2
(45) Date of Patent: Oct. 12, 2010

(54) HYGIENIC APPARATUS INCLUDING A TOILET BOWL AND A URINAL

(76) Inventors: Yi-Nan Yang, 10F., No. 37, Hsing-Shan Rd., Nei-Hu Dist., Taipei City (TW); Chyong-Yu Liang, 10F., No. 37, Hsing-Shan Rd., Nei-Hu Dist., Taipei City (TW)

( * ) Notice: Subject to any disclaimer, the term of this patent is extended or adjusted under 35 U.S.C. 154(b) by 471 days.

(21) Appl. No.: 12/025,185

(22) Filed: Feb. 4, 2008

(65) Prior Publication Data

US 2008/0189845 A1 Aug. 14, 2008

(30) Foreign Application Priority Data

Feb. 9, 2007 (TW) ..... 96104805 A

(51) Int. Cl.
*E03D 1/22* (2006.01)

(52) U.S. Cl. ..... 4/342

(58) Field of Classification Search ..... 4/300, 4/301, 340–342, 661
See application file for complete search history.

(56) References Cited

U.S. PATENT DOCUMENTS 3,969,133 A * 7/1976 McTighe et al. ..... 134/21
5,279,008 A * 1/1994 Ritter ..... 4/662
5,857,228 A * 1/1999 Waltenberger et al. ..... 4/662

* cited by examiner

*Primary Examiner*—Charles Phillips
(74) *Attorney, Agent, or Firm*—Frommer Lawrence & Haug LLP; Ronald R. Santucci

(57) ABSTRACT

A hygienic apparatus includes a urinal, a toilet bowl, and a water-storing device including a housing body interconnecting the urinal and the toilet bowl, a water tank disposed in the housing body, a water-feeding tube allowing flow of water into the water tank therethrough. A drain tube unit is in fluid communication with the urinal and the toilet bowl. A flush unit includes a urinal-flushing tube in fluid communication with the water tank and the urinal, and a toilet-flushing tube in fluid communication with the water tank and the toilet bowl. A swivel mechanism includes a base, a vertical shaft disposed fixedly on the base and extending into an assembly of the urinal, the toilet bowl, and the water-storing device, and a driving unit operable to drive rotation of the assembly of the urinal, the toilet bowl, and the water-storing device relative to the base about the vertical shaft.

17 Claims, 9 Drawing Sheets

HYGIENIC APPARATUS INCLUDING A TOILET BOWL AND A URINAL

CROSS-REFERENCE TO RELATED APPLICATION

This application claims priority of Taiwanese Application No. 096104805, filed on Feb. 9, 2007, the disclosure of which is incorporated herein by reference.

BACKGROUND OF THE INVENTION

1. Field of the Invention

This invention relates to hygienic equipment, and more particularly to a hygienic apparatus that includes a urinal and a toilet bowl.

2. Description of the Related Art

A toilet bowl typically includes a seat disposed pivotally on a bowl body and pivotable between a horizontal usable position and an upright idle position. When the seat is pivoted to the upright position, the toilet bowl can serve as a male urinal.

With such a configuration, pivoting movement of the seat between the horizontal usable position and the upright position may be required prior to use. Furthermore, due to the limited height of the toilet bowl, during use of the toilet bowl as a male urinal, the seat as well as the bowl body and a floor area surrounding the bowl body may be stained by urine. To solve this problem, a male urinal can be provided in proximity to and spaced apart from the toilet bowl. However, the provision of a male urinal and a toilet bowl as separate devices results in a substantial indoor space being used.

SUMMARY OF THE INVENTION

The object of this invention is to provide a hygienic apparatus that includes a toilet bowl and a urinal and that can overcome the above-mentioned disadvantages associated with the prior art.

According to this invention, a hygienic apparatus includes a urinal, a toilet bowl, and a water-storing device including a housing body interconnecting the urinal and the toilet bowl, a water tank disposed in the housing body, and a water-feeding tube allowing flow of water into the water tank therethrough. A drain tube unit is in fluid communication with the urinal and the toilet bowl. A flush unit includes a urinal-flushing tube in fluid communication with the water tank and the urinal, and a toilet-flushing tube in fluid communication with the water tank and the toilet bowl. A swivel mechanism includes a base, a vertical shaft disposed fixedly on the base and extending into an assembly of the urinal, the toilet bowl, and the water-storing device, and a driving unit operable to drive rotation of the assembly of the urinal, the toilet bowl, and the water-storing device relative to the base about the vertical shaft.

Preferably, a wall is formed with a cavity, and the urinal can be rotated into the cavity when it is not in use. As a result, the indoor space occupied by the hygienic apparatus and exposed outwardly of the wall is reduced significantly.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
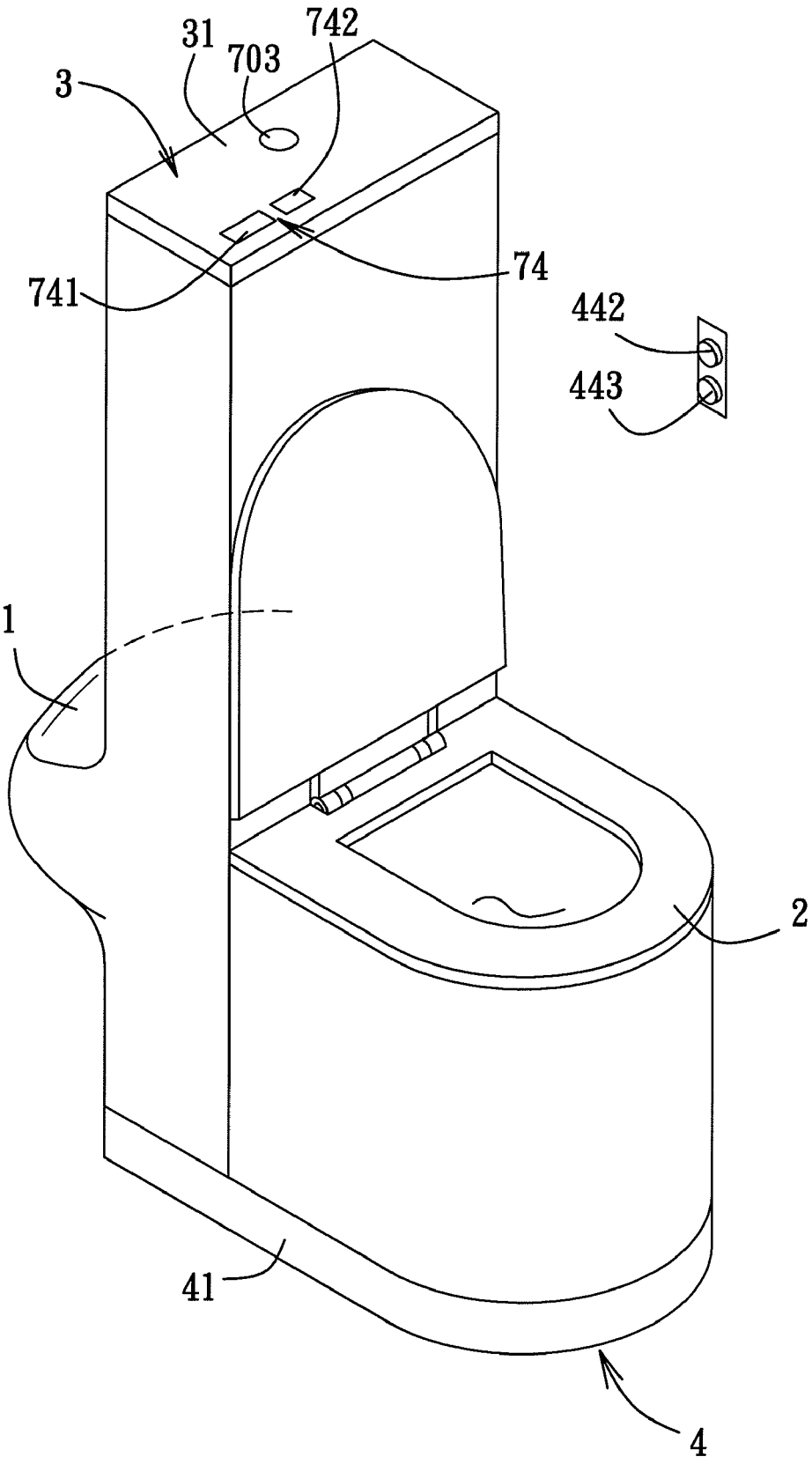
FIG. 1 is a perspective view of the first preferred embodiment of a hygienic apparatus according to this invention.

Before the present invention is described in greater detail in connection with the preferred embodiments, it should be noted that similar elements and structures are designated by like reference numerals throughout the entire disclosure.

Figure 2:
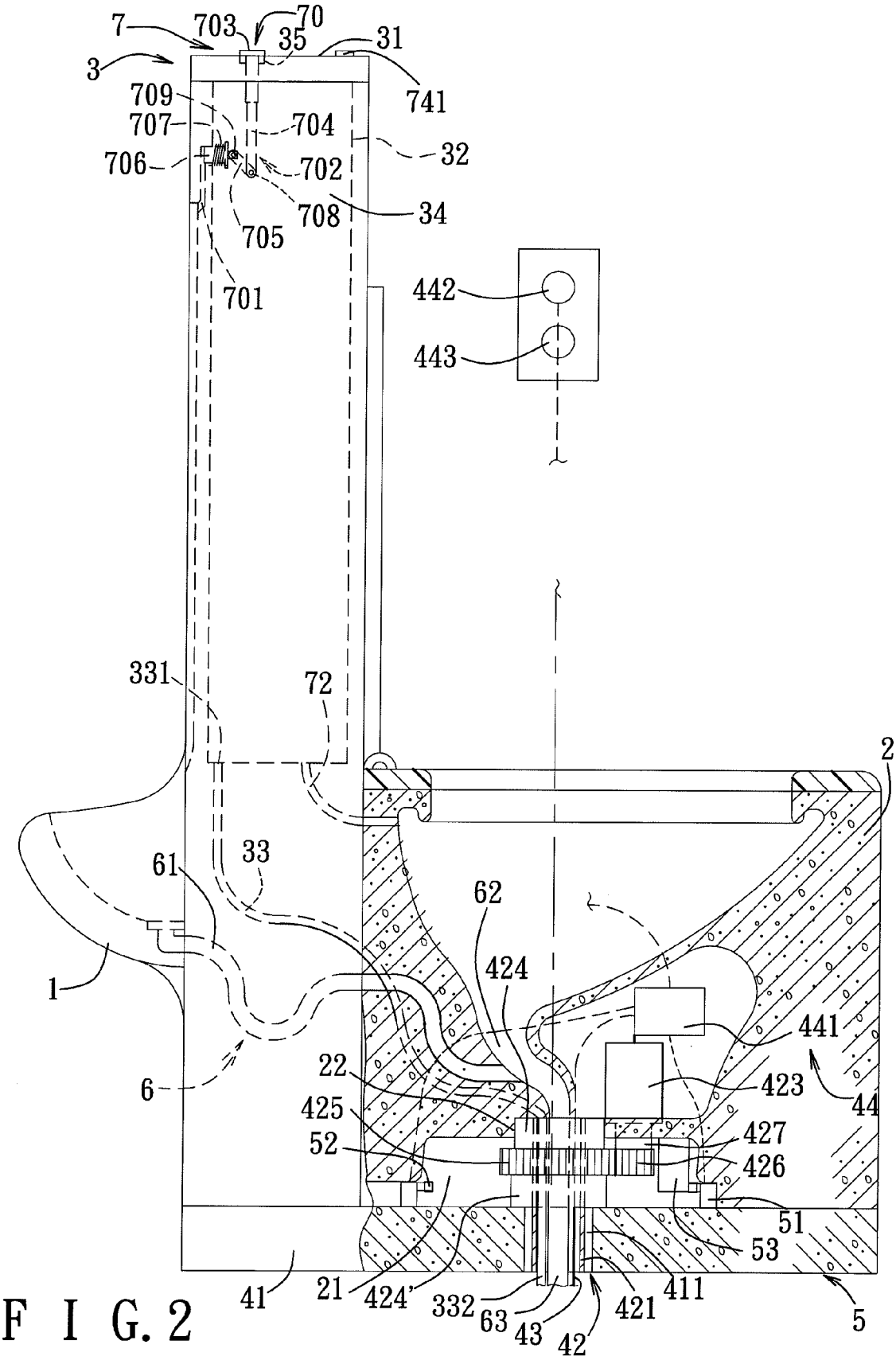
FIG. 2 is a schematic sectional view of the first preferred embodiment.

Referring to FIGS. 1 and 2, the first preferred embodiment of a hygienic apparatus according to this invention is disposed in a bathroom, and includes a male urinal 1, a toilet bowl 2, a water-storing device 3, a swivel mechanism 4, a drain tube unit 6, and a flush unit 7.

The toilet bowl 2 has a bottom surface formed with a recess 21 and a pivot hole 22. The water-storing device 3 includes a housing body 31, a water tank 32, and a water-feeding tube 33. The housing body 31 is disposed between the urinal 1 and the toilet bowl 2 to interconnect the same. The water tank 32 is disposed in the housing body 31 to define a water-storing space 34. The water-feeding tube 33 is configured as a hose, and is in fluid communication with the water-storing space 34 to allow flow of water into the water-storing space 34 therethrough.

The drain tube unit 6 includes a first tube 61, a second tube 62, and a drain tube 63. The first tube 61 is in fluid communication with the urinal 1 and the drain tube 63. The second tube 62 is in fluid communication with the toilet bowl 2 and the drain tube 63. The first and second tubes 61, 62 cooperate to allow flow of sewage from the urinal 1 and the toilet bowl 2 into the drain tube 63 therethrough.

The flush unit 7 includes a urinal-flushing device 70 and a toilet-flushing device. The toilet-flushing device includes a toilet-flushing tube 72 in fluid communication with the water tank 32 and the toilet bowl 2, and an operating unit. The operating unit includes a buoy (not shown), a valve (not shown), a swing rod (not shown), a cord (not shown) interconnecting the swing rod and the valve, and a pushbutton unit 74 connected to the valve in a known manner and operable to allow flow of water from the water tank 32 into the toilet-flushing tube 72. The pushbutton unit 74 includes a first control button 741 operable to perform a flushing operation on the toilet bowl 2 with a small amount of water, and a second control button 742 operable to perform a flushing operation on the toilet bowl 2 with a large amount of water.

Figure 7:
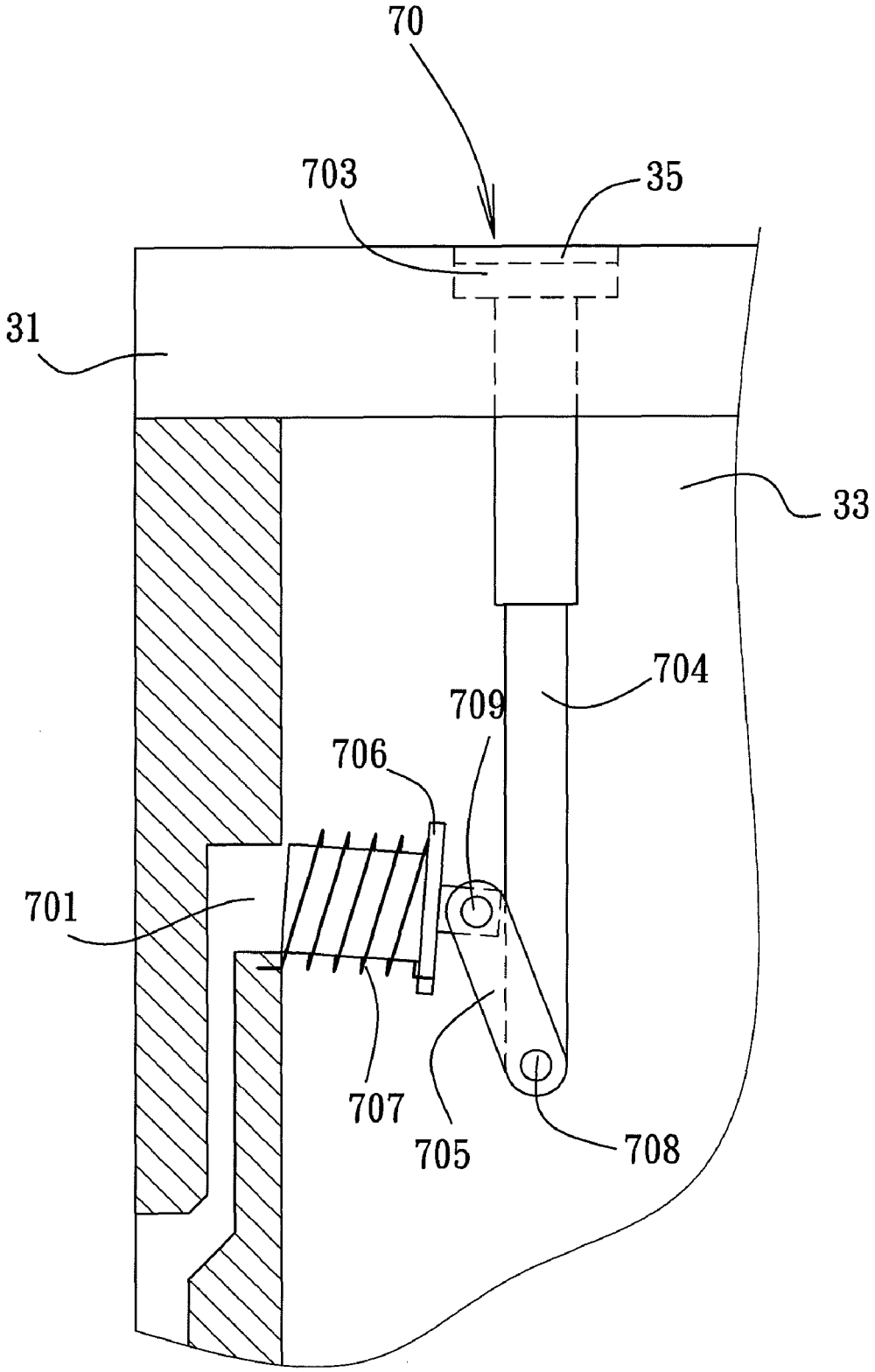
FIG. 7 is a fragmentary sectional view of the first preferred embodiment, illustrating a flush unit.

The urinal-flushing device 70 includes a urinal-flushing tube 701 in fluid communication with the water tank 32 and the urinal 1, and an operating unit 702. The operating unit 702 includes a control member 703 configured as a pushbutton and disposed movably on the housing body 31 for manual operation, a first link 704, a second link 705, a seal plug 706, and a resilient member 707. The seal plug 706 is inserted removably into an inlet in the urinal-flushing tube 701 to prevent flow of water from the water tank 32 into the urinal-flushing tube 701. The first link 704 has an upper end connected fixedly to the control member 703. The second link 705 has two ends (i.e., upper and lower ends) connected respectively and pivotally to the seal plug 706 and a lower end of the first link 704. The resilient member 707 is configured as a coiled tension spring, and has one end fastened to a wall of the water tank 32, and the other end fastened to the seal plug 706. As such, the control member 703 can be pressed to move the first link 704 downwardly. If this is done, with further reference to FIG. 7, the upper end of the second link 705 is moved away from the urinal-flushing tube 701 to remove the seal plug 706 from the inlet in the urinal-flushing tube 701, thereby allowing flow of water from the water tank 32 into the urinal 1 via the urinal-flushing tube 701 and stretching the resilient member 707 to store a restoration force.

Subsequently, when the control member 703 is released, the control member 703, the first link 704, and the second link 705 are returned to their original positions shown in FIG. 2 as a result of the restoration force of the resilient member 707.

Figure 3:
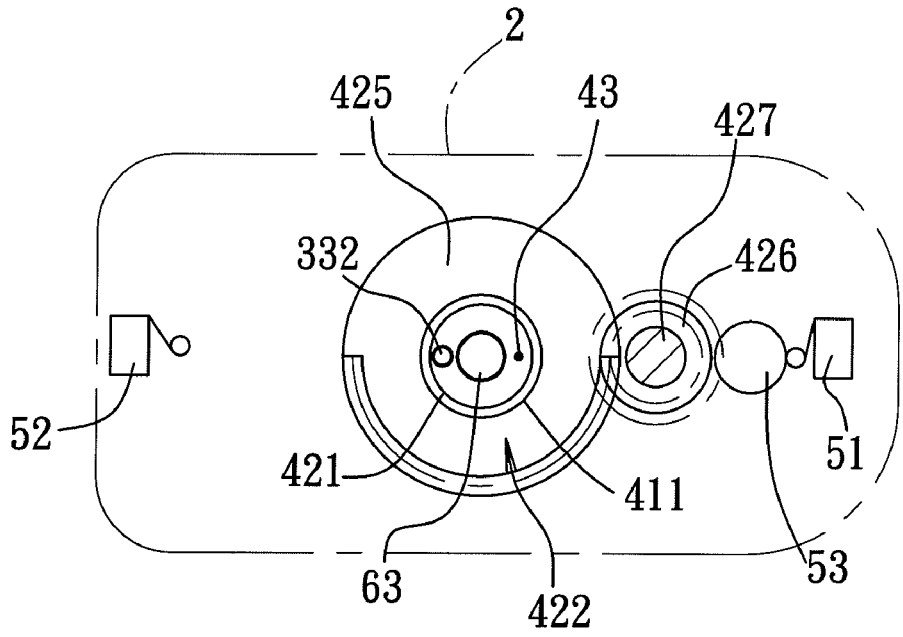
FIG. 3 is a schematic view of a driving unit and a position-limiting unit of the first preferred embodiment, illustrating how a third position-limiting member is in contact with a first position-limiting member.
Figure 4:
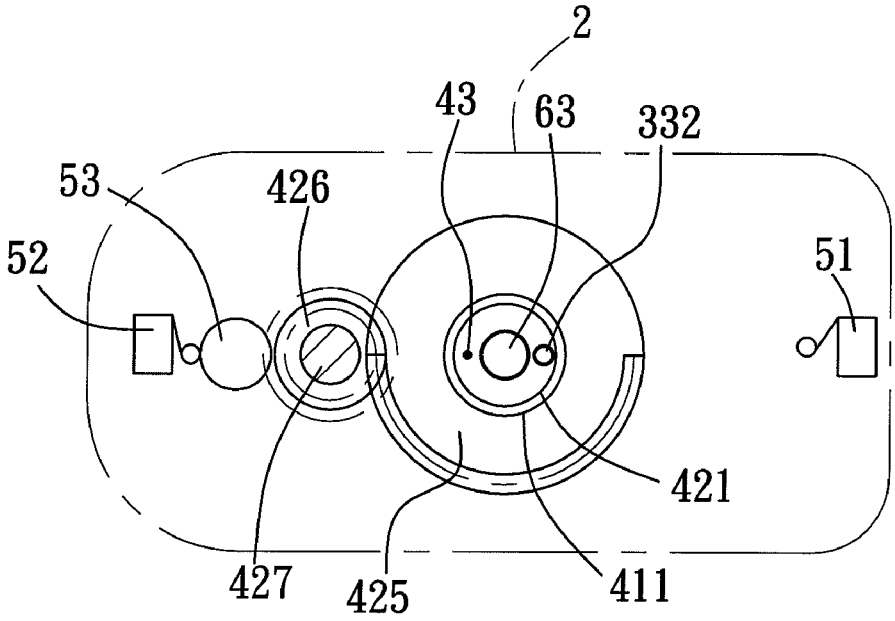
FIG. 4 is a view similar to FIG. 3 but illustrating how the third position-limiting member is in contact with a second position-limiting member.

With further reference to FIGS. 3 and 4, the swivel mechanism 4 includes a base 41, a swivel device 42, a power cable 43, a control unit 44, and a position-limiting unit 5. The base 41 is disposed under the urinal 1, the toilet bowl 2, and the water-storing device 3, and has a vertical hole 411 formed therethrough. The swivel device 42 includes a hollow vertical shaft 421, a driving unit 422, and a pair of upper and lower ball bearings 424, 424'. The vertical shaft 421 extends through the vertical hole 411 in the base 41 and the pivot hole 22 in the toilet bowl 2, and is disposed fixedly within the base 41.

The driving unit 422 includes a pair of first and second gears 425, 426 disposed in the recess 21 in the toilet bowl 2, and a motor 423 disposed in the toilet bowl 2. The first gear 425 is sleeved fixedly and coaxially on the vertical shaft 421. The second gear 426 is disposed in the toilet bowl 2, is connected fixedly to an output shaft 427 of the motor 423, and meshes with the first gear 425. The second gear 426 can be driven by the motor 423 to rotate on and about the first gear 425 to thereby drive rotation of an assembly of the urinal 1, the toilet bowl 2, and the water-storing device 3 relative to the base 41 about the vertical shaft 421. As such, the urinal 1 is rotatable between a concealed position shown in FIG. 5 whereat the urinal 1 is concealed within a cavity 81 in a wall 8 of the bathroom, and an exposed position in FIG. 6 whereat the urinal 1 is exposed outwardly of the wall 8. The upper and lower ball bearings 424, 424' abut respectively against top and bottom ends of the first gear 425, and are disposed around the vertical shaft 421. The upper bearing 424 is received within the pivot hole 22 in the toilet bowl 2 in a close-fitting manner. The lower bearing 424' is disposed in the recess 21 in the toilet bowl 2 and between the toilet bowl 2 and the base 41.

Figure 5:
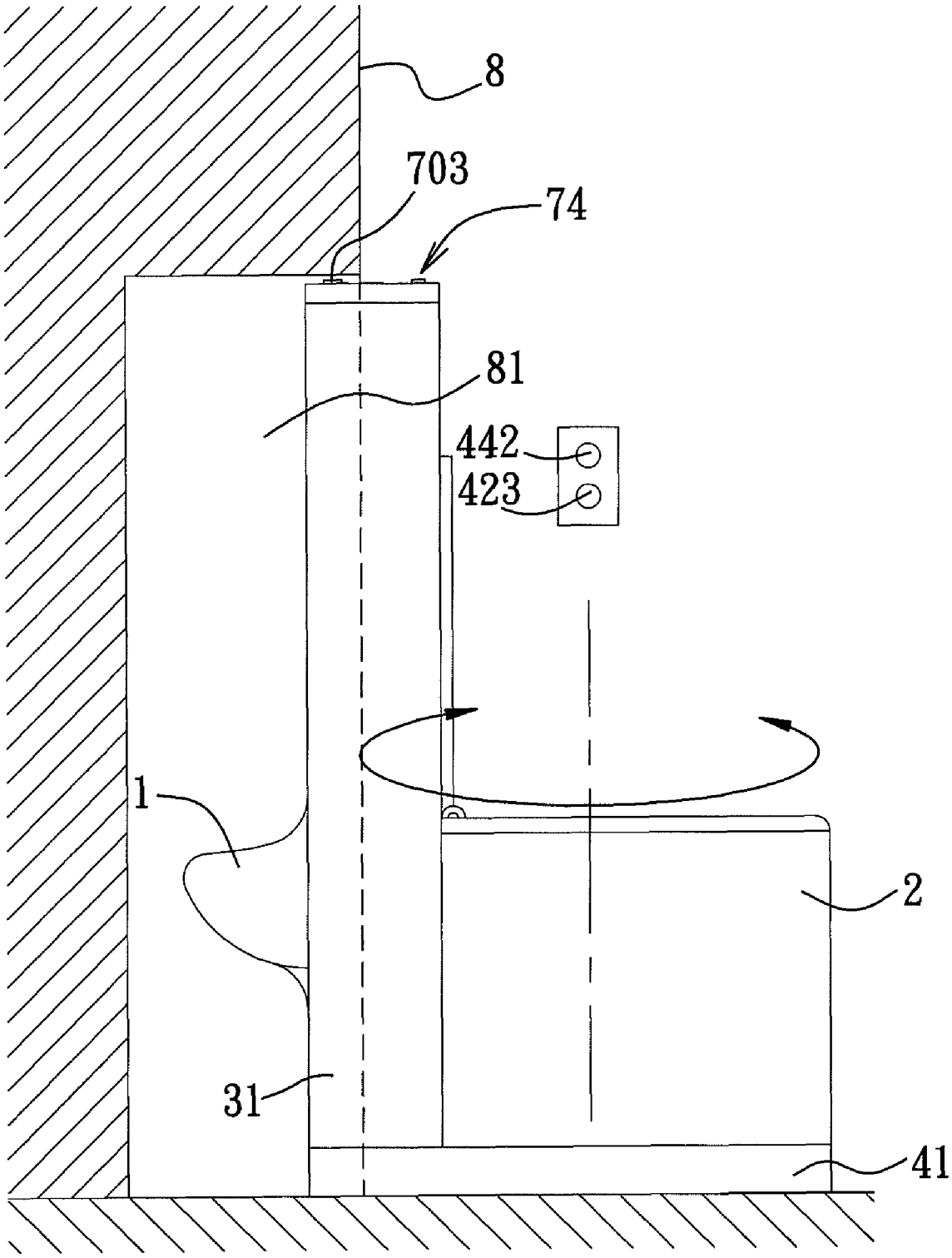
FIG. 5 is a schematic view of the first preferred embodiment, illustrating a concealed position of a urinal.
Figure 6:
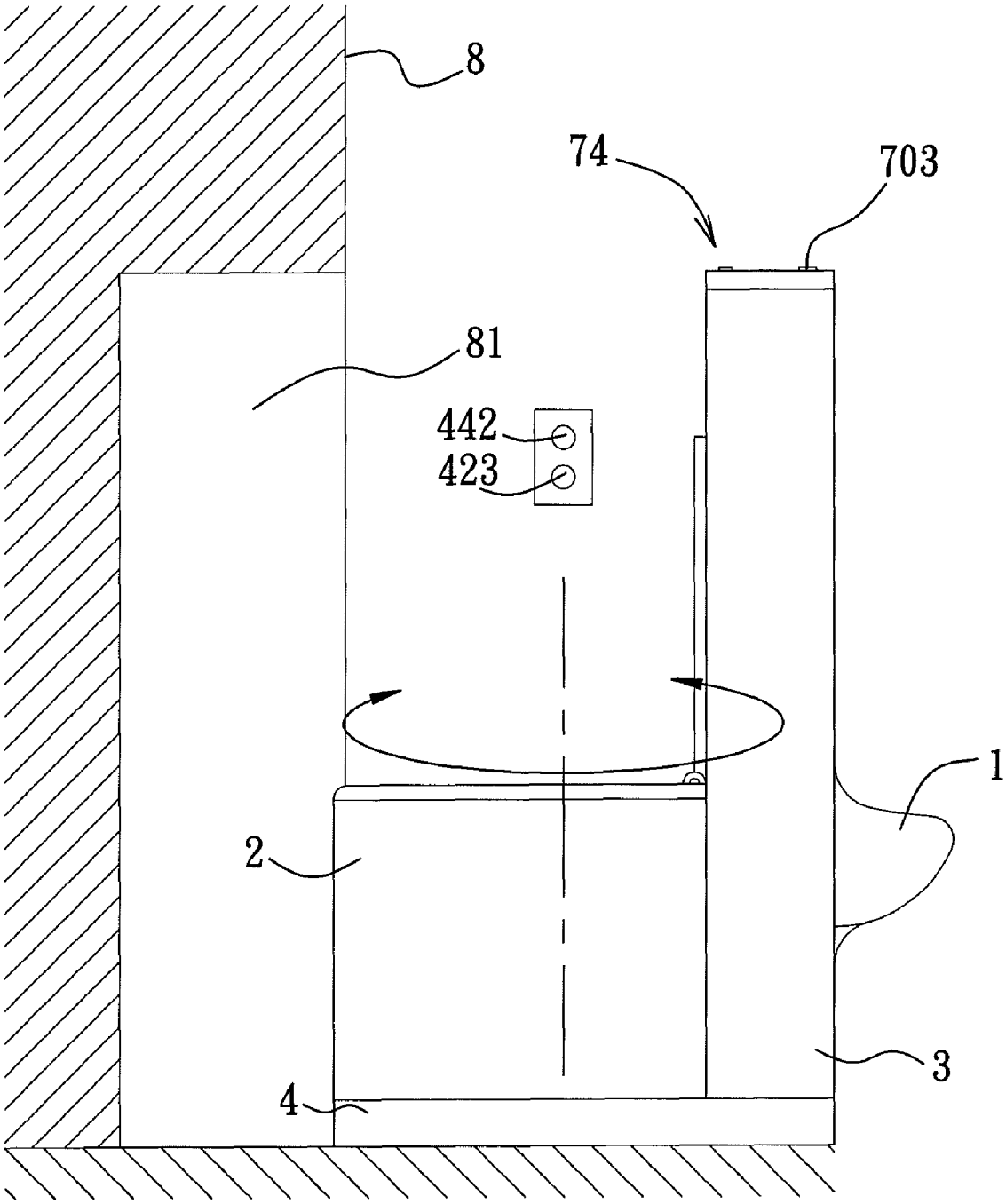
FIG. 6 is a view similar to FIG. 5 but illustrating an exposed position of the urinal.

The control unit 44 includes a circuit board module 441 disposed in the toilet bowl 2, and a pair of first and second control buttons 442, 443 in electrical connection with the circuit board module 441. The circuit board module 441 is in electrical connection with the motor 423 and a power cable 43 (see FIGS. 3 and 4) extending through the vertical shaft 421 and in electrical connection with an external power source (not shown). The first and second control buttons 442, 443 are disposed on a wall of the bathroom, and are operable to rotate the output shaft 427 of the motor 423 in two directions, respectively, as shown in FIGS. 5 and 6. When the urinal 1 is in the concealed position and when the first control button 442 is pressed, the urinal 1 is rotated in a direction to the exposed position. Subsequently, when the second control button 443 is pressed, the urinal 1 is rotated in an opposite direction to thereby return to the concealed position.

Alternatively, an assembly of the motor 423, the control unit 44, and the power cable 43 may be replaced with a manual operation unit.

The position-limiting unit 5 includes a pair of first and second position-limiting members 51, 52 disposed on and respectively adjacent to two opposite sides of the base 41 and flanking the vertical shaft 421, and a third position-limiting member 53 disposed in the recess 21 in the toilet bowl 2. The third position-limiting member 53 is rotatable on the base 41 to align with either of the first and second position-limiting members 51, 52, as shown in FIGS. 3 and 4, to thereby stop operation of the driving unit 422. Thus, rotation of the assembly of the urinal 1, the toilet bowl 2, and the water-storing device 3 about the vertical shaft 421 is limited within an angle of 180°.

In this embodiment, the first and second position-limiting members 51, 52 are configured as micro-switches, and are in electrical connection with the circuit board module 441. The third position-limiting member 53 is rotatable to contact either of the first and second position-limiting members 51, 52. Alternatively, the first and second position-limiting members 51, 52 may be configured as projections for stopping the third position-limiting member 53 when the third position-limiting member 53 comes into contact therewith. In addition, the motor 423 may be a stepping motor, in which case the position-limiting unit 5 can be omitted. Further, either the first gear 425 or the second gear 426 may be formed with gear teeth extending along an angular length of 180 degrees to limit the rotational angle of the assembly of the urinal 1, the toilet bowl 2, and the water-storing device 3.

The first and second gears 425, 426 may be replaced with a transmission belt unit. The motor 423 can be a D.C. frequency change motor.

Figure 8:
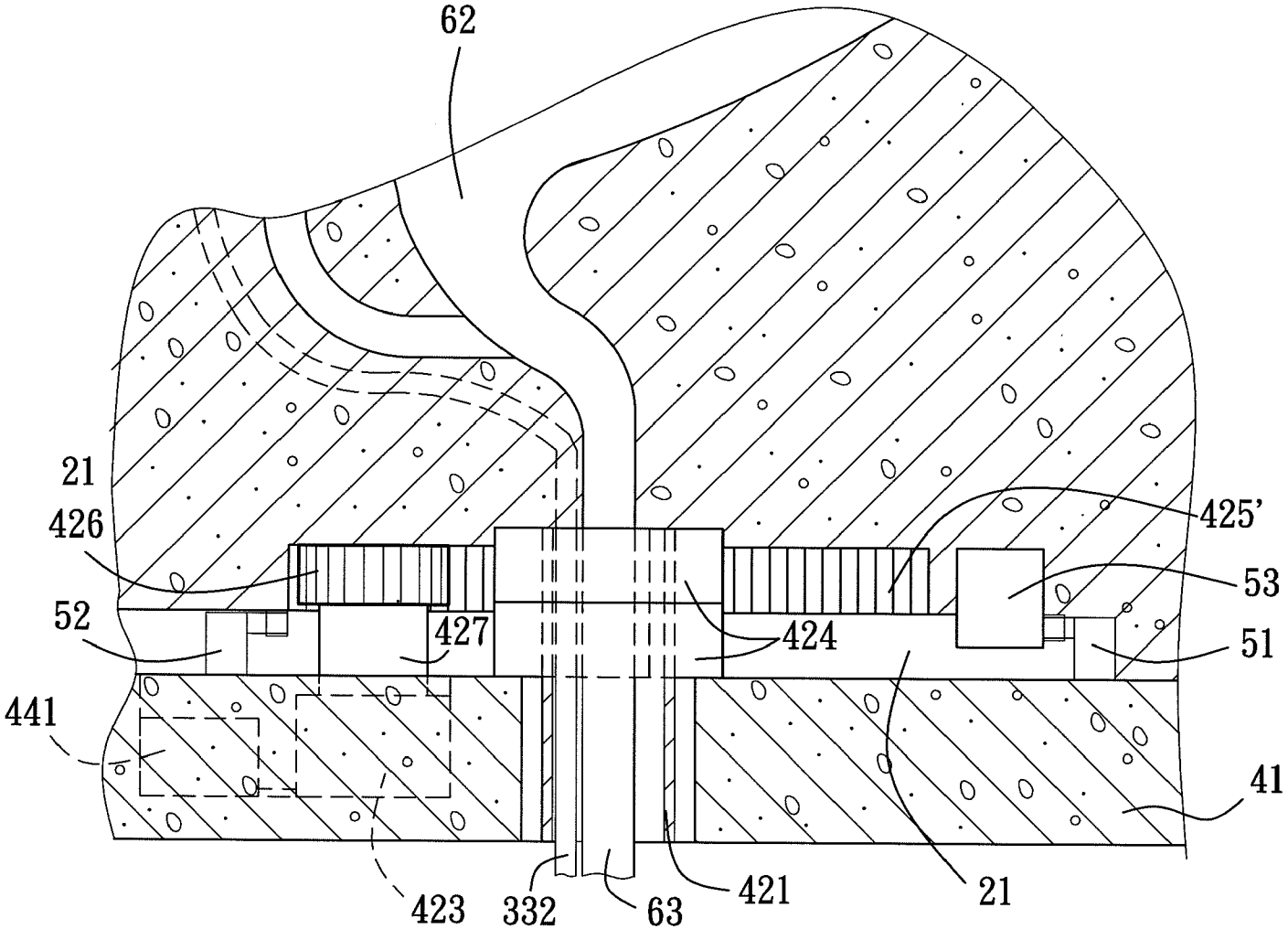
FIG. 8 is a schematic sectional view of the second preferred embodiment of a hygienic apparatus according to this invention, illustrating a modified driving unit.
Figure 9:
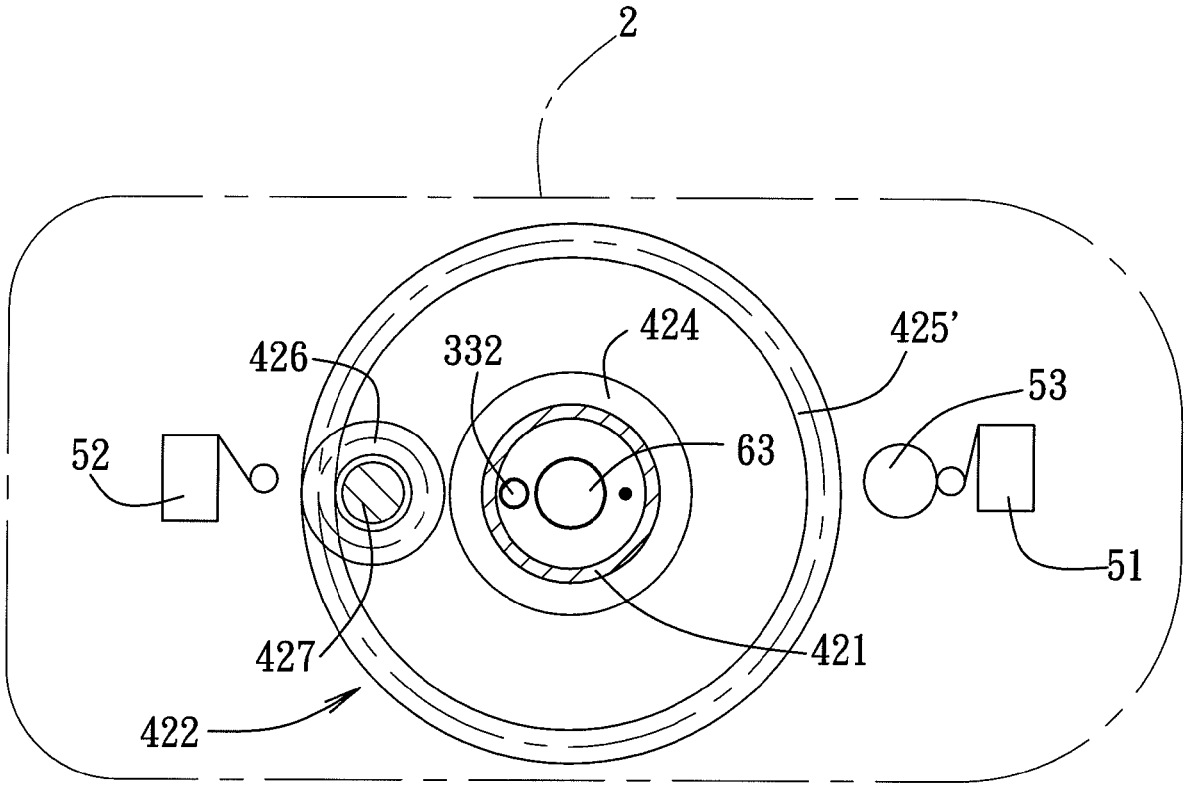
FIG. 9 is a schematic view of the driving unit and a position-limiting unit of the second preferred embodiment, illustrating how a third position-limiting member is in contact with a first position-limiting member.

FIGS. 8 and 9 show a modified driving unit that is similar in construction to the driving unit 422. In this embodiment, the first gear 425' is configured as an internal gear to allow rotation of the second gear 426 therewithin, and the motor 423 and the circuit board module 441 are disposed in the base 41.

Figure 10:
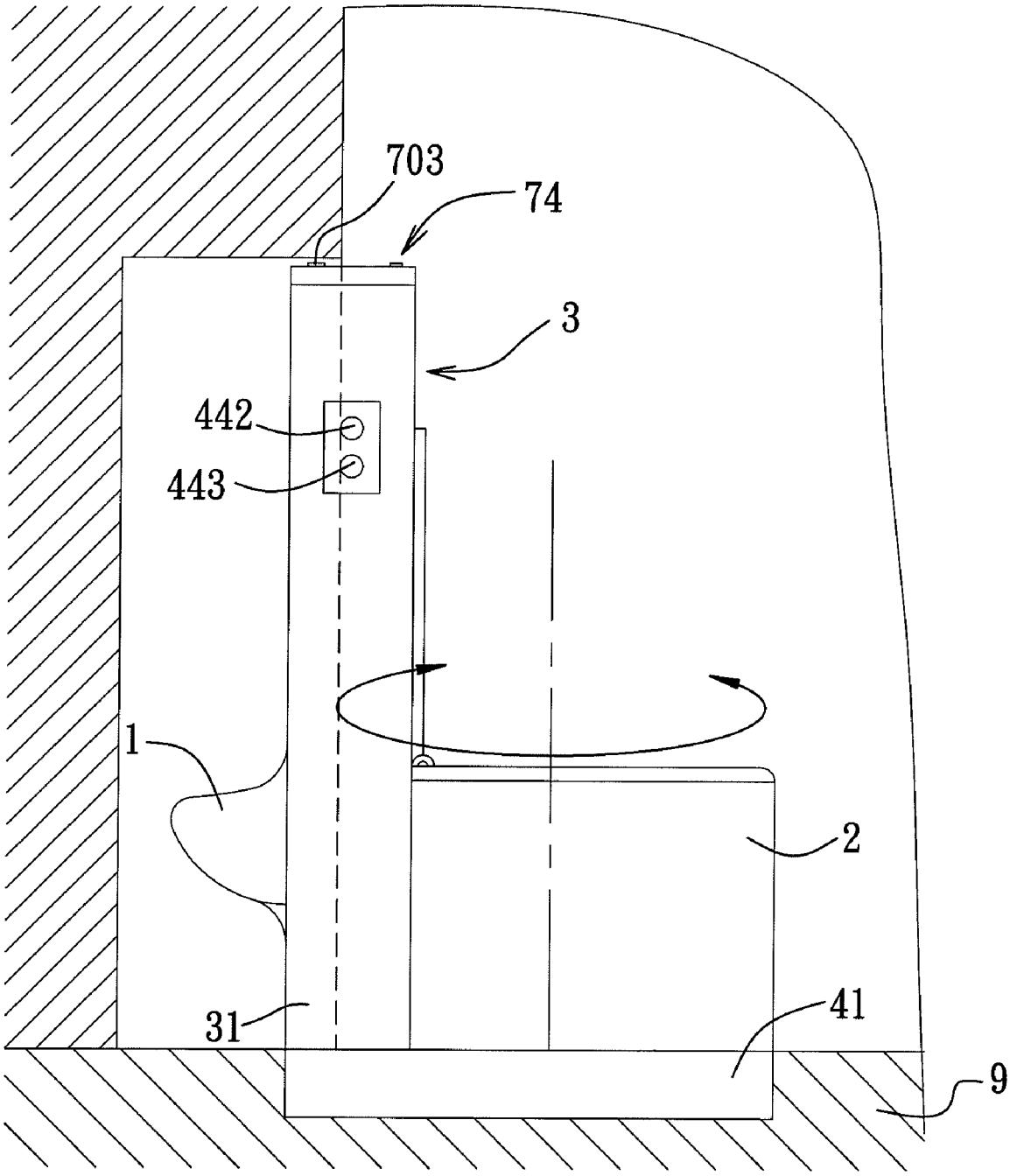
FIG. 10 is a schematic sectional view illustrating a modified control unit.

Referring to FIG. 10, the base 41 can be embedded within a floor 9, and the first and second control buttons 442, 443 may be disposed on the housing body 31 of the water-storing device 3.

With this invention thus explained, it is apparent that numerous modifications and variations can be made without departing from the scope and spirit of this invention. It is therefore intended that this invention be limited only as indicated by the appended claims.

We claim:

1. A hygienic apparatus comprising:

a urinal;

a toilet bowl;

a water-storing device including a housing body interconnecting said urinal and said toilet bowl, a water tank disposed in said housing body, a water-feeding tube in fluid communication with said water tank and adapted to allow flow of water into said water tank via said water-feeding tube;

a flush unit including a urinal-flushing tube in fluid communication with said water tank and said urinal, and a toilet-flushing tube in fluid communication with said water tank and said toilet bowl;

a swivel mechanism including a base, a hollow vertical shaft disposed fixedly on said base and extending into an assembly of said urinal, said toilet bowl, and said water-storing device, and a driving unit operable to drive rotation of said assembly of said urinal, said toilet bowl, and said water-storing device relative to said base about said vertical shaft; and a drain tube unit in fluid communication with said urinal and said toilet bowl and including a drain tube extending through said vertical shaft.

2. The hygienic apparatus as claimed in claim 1, wherein said swivel mechanism further includes a position-limiting unit, said position-limiting unit including first and second position-limiting members disposed on and respectively adjacent to two opposite sides of said base, and a third position-limiting member disposed on said toilet bowl and rotatable on said base to align with either of said first and second position-limiting members to thereby stop operation of said driving unit.

3. The hygienic apparatus as claimed in claim 1, wherein said driving unit includes a first gear sleeved fixedly on said vertical shaft, and a second gear disposed in said toilet bowl and meshing with said first gear, said second gear being rotatable on and about said first gear to drive rotation of said assembly of said urinal, said toilet bowl, and said water-storing device relative to said base about said vertical shaft.

4. The hygienic apparatus as claimed in claim 3, wherein said driving unit further includes a motor disposed on said toilet bowl and operable to rotate said second gear about said first gear.

5. The hygienic apparatus as claimed in claim 4, wherein said swivel mechanism further includes a control unit in electrical connection with said motor, said control unit including a circuit board module and two control buttons in electrical connection with said circuit board module, said control buttons being operable to rotate said motor in two directions, respectively.

6. The hygienic apparatus as claimed in claim 5, wherein said circuit board module is disposed in said toilet bowl, and said control buttons are adapted to be mounted on a wall.

7. The hygienic apparatus as claimed in claim 6, wherein said swivel mechanism further includes a position-limiting unit, said position-limiting unit including first and second position-limiting members disposed on and respectively adjacent to two opposite sides of said base, and a third position-limiting member disposed on said toilet bowl and rotatable on said base to contact either of said first and second position-limiting members to thereby stop operation of said driving unit.

8. The hygienic apparatus as claimed in claim 7, wherein said first and second position-limiting members are configured as micro-switches, and are in electrical connection with said circuit board module, said third position-limiting member being rotatable to contact either of said first and second position-limiting members to thereby stop operation of said driving unit.

9. The hygienic apparatus as claimed in claim 1, wherein said swivel mechanism further includes a ball bearing disposed around said vertical shaft between said toilet bowl and said base.

10. The hygienic apparatus as claimed in claim 1, wherein said urinal-flushing tube has an inlet, said flush unit further including a control member disposed movably on said housing body of said water-storing device and allowing for manual operation, a seal plug inserted removably into said inlet in said urinal-flushing tube to prevent flow of water from said water tank into said urinal-flushing tube, a first link having an end connected fixedly to said control member, a second link having two ends connected respectively and pivotally to said seal plug and said first link, and a resilient member sleeved on said seal plug and having one end fastened to a wall of said water tank, and the other end fastened to said seal plug.

11. The hygienic apparatus as claimed in claim 1, wherein said drain tube unit further includes a first tube in fluid communication with said urinal and said drain tube, and a second tube in fluid communication with said toilet bowl and said drain tube, said first and second tubes cooperating to allow flow of sewage from said urinal and said toilet bowl into said drain tube therethrough.

12. The hygienic apparatus as claimed in claim 1, wherein said housing body of said water-storing device is disposed between said urinal and said toilet bowl.

13. The hygienic apparatus as claimed in claim 1, wherein driving unit includes a first gear configured as an internal gear and disposed fixedly in said toilet bowl, and a second gear disposed fixedly on said base and meshing with said first gear, said second gear being rotatable within said first gear to drive rotation of said assembly of said urinal, said toilet bowl, and said water-storing device relative to said base about said vertical shaft.

14. The hygienic apparatus as claimed in claim 13, wherein said driving unit further includes a motor disposed in said base for driving rotation of said second gear relative to said first gear.

15. The hygienic apparatus as claimed in claim 14, wherein said swivel mechanism further includes a control unit in electrical connection with said motor, said control unit including a circuit board module and two control buttons in electrical connection with said circuit board module, said control buttons being operable to rotate said motor in two directions, respectively.

16. The hygienic apparatus as claimed in claim 15, wherein said circuit board module is disposed in said toilet bowl, and said control buttons are adapted to be mounted on a wall.

17. The hygienic apparatus as claimed in claim 16, wherein said swivel mechanism further includes a position-limiting unit, said position-limiting unit including first and second position-limiting members disposed on and respectively adjacent to two opposite sides of said base, and a third position-limiting member disposed on said toilet bowl and rotatable on said base to contact either of said first and second position-limiting members to thereby stop operation of said driving unit.

* * * * *